US006254101B1

(12) United States Patent
Young

(10) Patent No.: US 6,254,101 B1
(45) Date of Patent: Jul. 3, 2001

(54) FLOOR GAME FOR TEAM BUILDING

(75) Inventor: Jason Phillips Young, Plano, TX (US)

(73) Assignee: Interface, Inc., Atlanta, GA (US)

( * ) Notice: Subject to any disclaimer, the term of this patent is extended or adjusted under 35 U.S.C. 154(b) by 0 days.

(21) Appl. No.: 09/289,881

(22) Filed: Apr. 12, 1999

(51) Int. Cl.[7] ..... A63F 9/24; A63B 71/04

(52) U.S. Cl. ..... 273/460; 273/440; 273/441; 273/444; 273/459; 273/242; 273/275; 273/287

(58) Field of Search ..... 273/440, 441, 273/444, 459, 460, 236, 242, 244, 275, 284, 287; 359/483, 485, 896

(56) References Cited

U.S. PATENT DOCUMENTS

| | | | | |
|---|---|---|---|---|
| 3,111,313 | | 11/1963 | Parks . | |
| 3,454,279 | | 7/1969 | Foley et al. . | |
| 3,484,106 | | 12/1969 | Foley et al. . | |
| 3,630,526 | * | 12/1971 | Winkless, III | 273/237 |
| 3,761,084 | | 9/1973 | Dieckmann . | |
| 3,879,034 | * | 4/1975 | Petrusek | 273/444 |
| 4,009,880 | | 3/1977 | Lammersen . | |
| 4,982,959 | | 1/1991 | Rudell et al. . | |
| 5,020,882 | * | 6/1991 | Makow | 350/335 |
| 5,248,152 | | 9/1993 | Timmerman . | |
| 5,711,529 | | 1/1998 | Nielsen et al. . | |
| 5,717,522 | * | 2/1998 | Hattori et al. | 359/465 |
| 5,963,371 | * | 10/1999 | Needham et al. | 359/464 |

* cited by examiner

*Primary Examiner*—Raleigh W. Chiu
(74) *Attorney, Agent, or Firm*—Kyle M. Globerman, Esq.; John S. Pratt, Esq.; Kilpatrick Stockton LLP

(57) ABSTRACT

A floor game including tiles which are laid on a playing surface forming a playing area, and an optical instrument. Each tile is covered by a polarized film. A path across the playing area is revealable by utilizing the optical instrument available to a game facilitator. The players see a design on the playing area. A path across the playing area is invisible to players not wearing the optical instrument. Each player traverses the path with assistance of the game facilitator and by observing steps taken by the previous players. The object of the game is for players to discover and traverse the path across the playing area from end to end through a team effort. In an alternative embodiment, the game is played with one or more teams utilizing one or more playing areas with each team trying to complete a path on their respective playing area.

28 Claims, 3 Drawing Sheets

FLOOR GAME FOR TEAM BUILDING

FIELD OF THE INVENTION

This invention relates generally to techniques for teaching teamwork and to floor games. It relates more particularly, to apparatus and methods for playing a floor game in which multiple tiles are arranged to form a playing area containing a path invisible to a naked eye, and players attempt to discover the path through a team effort.

BACKGROUND OF THE INVENTION

It is well known that light can be polarized. Unpolarized light, such as sunlight or light emitted from an ordinary incandescent light bulb, can become polarized light using light sensitive material such as tourmaline, or a polarized sheet or filter, such as filters manufactured by Polaroid Corporation. A polarized filter has complicated long molecules arranged with their axes parallel to a direction that is called the axis of the polarized filter. Such a polarized filter acts as a series of parallel slits to allow one orientation of polarization parallel to the axis of the polarized filter to pass through nearly undiminished, while blocking light with perpendicular polarization almost completely.

Unpolarized light consists of light with random directions of polarization. Each of these polarization directions can be divided into components along two mutually perpendicular directions. Thus, an unpolarized light beam can be thought of as two polarized beams of equal magnitude perpendicular to one another. When the unpolarized light beam strikes a first polarized filter or lens, the component with the polarization parallel to the axis of the polarized filter is allowed to pass. If a second polarized filter is positioned behind the first polarized filter at an orthogonal position, i.e., with their axes perpendicular to one another, the second polarized filter blocks the light component passed by the first polarized filter. This is because the axis of the second polarized filter is perpendicular to the polarization of the component of the light beam passed by the first filter. Therefore, the unpolarized light is entirely stopped.

Another means of producing polarized light from unpolarized light is by reflection. When light strikes a nonmetallic surface at any angle other than perpendicular, the reflected beam is polarized preferentially in the plane parallel to the surface. In other words, the component with polarization in the plane perpendicular to the surface is preferentially transmitted or absorbed. If an observer wears polarized sunglasses to receive the reflected beam, the observer can reduce glare to a minimum from that surface by rotating the polarized sunglasses or the surface so that the axis of the polarized sunglasses is perpendicular to the polarization of the reflected beam. If the light is reflected from the surface of a polarized sheet, a complete blackout by rotating either the polarized sunglasses or the polarized sheet can then be achieved.

Walking games utilizing optical instruments are also known in the art. For example, U.S. Pat. No. 3,111,313 issued to Parks teaches an optical illusion walking games in which a player attempts to walk along a line or trial shown on a rug, mat, etc. while looking through the wrong end of a binocular telescope. U.S. Pat. No. 5,711,529 issued to Nielson et al. discloses a mirror game in which a visual image alteration device contains a mirror held adjacent to the eyes to alter an image seen in the mirror by a person playing the game. Furthermore, U.S. Pat. No. 3,454,279 issued to Foley et al. describes a team game in which the players compete with each other for spaces or loci without falling down.

None of the prior games utilize polarized film and spectacles as part of the game or use an optical instrument in cooperation with a facilitator to facilitate game playing.

SUMMARY OF THE INVENTION

This invention is a training system utilizing a floor game including a matrix of tiles and an optical instrument. The tiles are laid on a surface forming a playing area. Patterns, such as arrows, on the tiles are visible to players. A path across the playing area is visible to a game facilitator utilizing the optical instrument. The facilitator using the optical instrument advises the players whether they are on the path revealed to the facilitator. Players working with each other and the facilitator traverse the path from end to end through a team effort.

The game is a team event, the object which is to get the entire team across the playing area one at a time. In playing the game, a first player makes a guess whether a particular tile is on the path. The facilitator tells the player whether his or her guess is correct. If the guess is correct, the player stands on that tile and makes another guess. If not, the player moves off the matrix and waits for his or her next opportunity to play. A second player then guesses the position of the next portion of the path, based on the learning from his or her predecessor. Play continues until a player traverses the entire path from end to end.

At any given step of the path, a participant has at least two (and usually more) possible directions to go. Thus, an appreciation of his or her predecessor(s)'s experience will enhance his or her chances to guess correctly. The whole team finishes the game quicker if everyone pays attention to each other's experience on the playing area. Thus, the process of playing the game becomes a team building experience among the players.

The compact, light weight tiles are easy to carry, set-up and/or move around. The game can be made in different colors and materials. In one embodiment, the tiles are made from a flexible material such as plastic. A polarized film is adhered to one side of the tile. Substantially identical marks, visible to a naked eye, are printed on a layer underneath the polarized film. The marks can be directional indicators such as arrows, or other suitable symbols. In one embodiment, the bottom surface of the tile is a rough texture. A rough bottom surface provides conformation between the tile and a playing surface and avoids slipping. Alternatively, the bottom surface of the tile has a smooth finish.

In an alternative embodiment, the game is played by one or more teams. Each team can have one or more players. Teams can play the game on the same playing area. Alternatively, teams can play the game on different playing areas. The game facilitator can set up different paths with the same number of the steps on the different playing areas. Each team then tries to find the path and cross the playing area first.

Objects of this invention include:

To provide a floor game for promoting learning from each other in an enjoyable team building environment.

To provide a floor game that can be played by one or more groups of players.

To provide a floor game played on a matrix of substantially identical tiles defining a playing area wherein a path is invisible to players and discoverable through a team effort.

To provide a floor game utilizing polarized film and polarized glasses for facilitating the game set up and the play.

To provide a floor game that requires simple, inexpensive and portable parts for its operation.

As the following description and accompanying drawings make clear, these and other objects are achieved by this invention.

DETAILED DESCRIPTION

Figure 1:
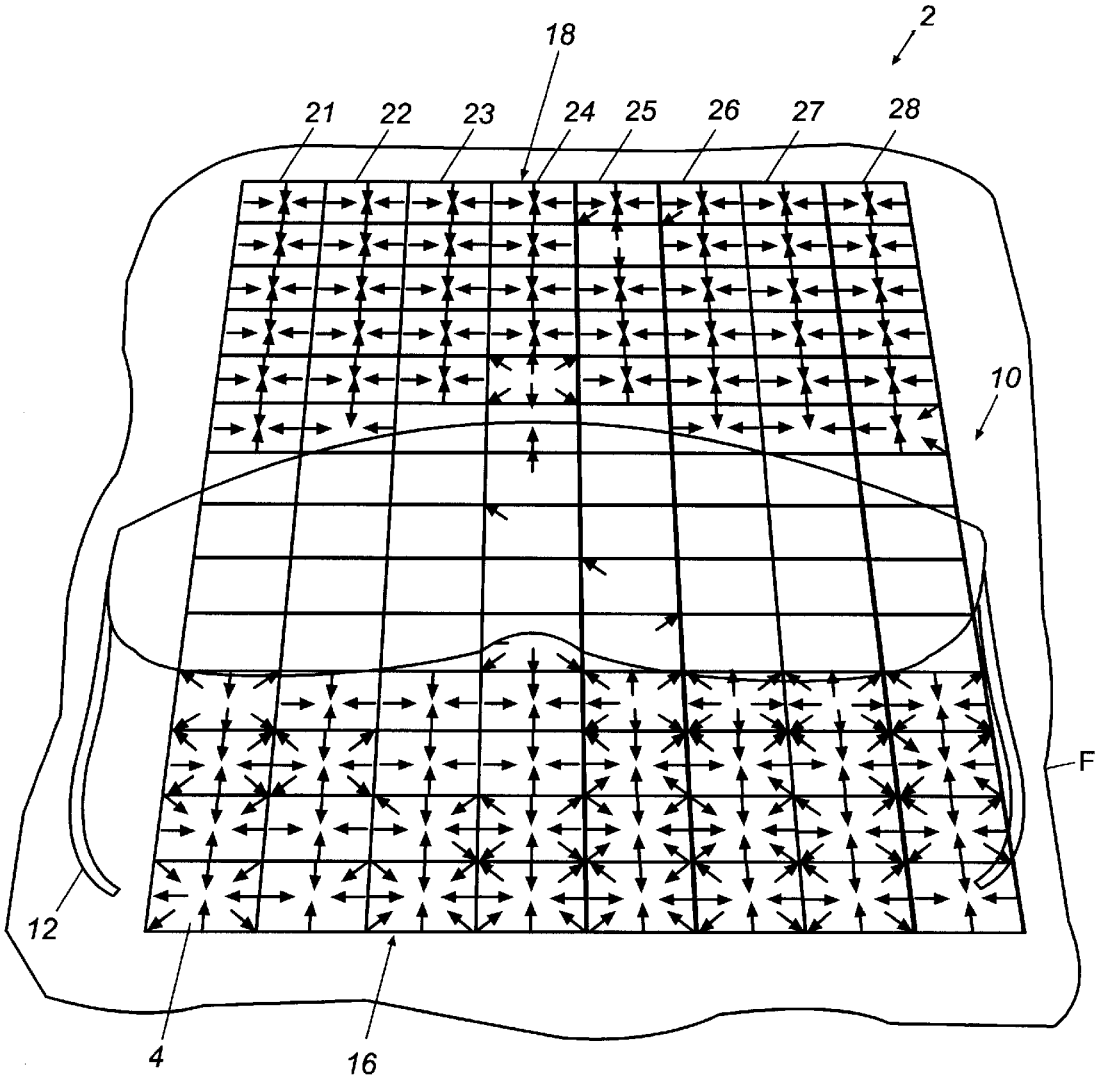
FIG. 1 shows a perspective view of a field view of tiles forming a playing area and an optical instrument through which a predetermined path through the tiles can be perceived.

FIG. 1 shows an example of a typical set up of the game 2 according to this invention. The game 2 includes a plurality of tiles 4 forming a playing area 10 and an optical instrument 12. The playing area 10 is established on a playing surface such as a floor, a ground surface or other proper supporting structure F. In a preferred embodiment, the playing area 10 is shaped as a square or rectangular playing area. However, an area of any other practical geometrical configuration, bounded by a continuous boundary line 14 is contemplated by this invention.

The playing area 10 is formed as a matrix of tiles 4. In one embodiment, the tiles 4 form columns which extend from one end 16 to the opposite end 18 of the playing area 10 and are generally indicated by reference numbers 21–28. Each column has a plurality of tiles 4. Any other suitable number of columns and rows can be employed to construct the playing area 10. Moreover, the playing area 10 can be enlarged or reduced before, during, or after the game by adding or removing tiles 4 from the mat. Each tile 4 is covered with a polarized film 32. The polarized film 32 can be adhered to the tile 4 utilizing a variety of methods including gluing, welding, sewing, or bonding the polarized film 32 to the tile 4. In an alternative embodiment, a layer of paper, plastic or other proper material 34 may be interposed between the tile 4 and the polarized film 32 to provide a better contrasting background.

Figure 2:
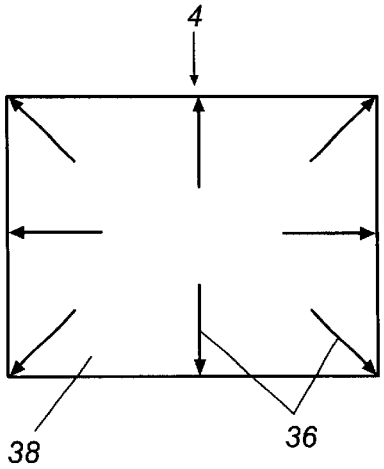
FIG. 2 shows a top view of the tile used in FIG. 1.

FIG. 2 shows a top view of the tile 4 used in FIG. 1 to form the playing area 10. A plurality of substantially identical indicia or marks 36 are printed, stamped or otherwise associated on an upper, playing surface 38 of the polarized film 32. The indicia 36 can be direction indicators such as arrows, letters, numbers, signs or symbols, that are visible to a naked eye. Preferably, the number of directional indicia equals the maximum possible directions one can go from a tile. For example, FIG. 2 shows eight arrows printed on polarized film 32 correspond to eight possible directions in which a player can move.

Customized tiles 4 utilizing different colors for different groups of players is contemplated with this invention. For example, bright colors can be used for games to be played in a school environment, and dark colors used for games played in an office environment.

The tile 4 is formed of flexible materials such as flexible plastics, for example vinyl plastic. A sheet of vinyl plastic is cut into square tiles, each with a film thickness from 0.01 to about 0.5 inch, preferably from about 0.1 to 0.5 inch. Any suitable size of the tiles 4 can be employed, for instance, 1×1 (inches square), 15×15 (inches square), 9×9 (inches square), or 13×13 (inches square). Preferably, the tiles are 9"×9" or 1"×1". However, the size of the tiles 4 should be large enough to provide a comfortable base for a player to stand on and small enough to reduce material cost and the weight for portability. Similarly, any proper thickness of the tiles 4 can be used where the thickness is sufficient to withstand the impact of frequent use by players with various weights yet thin enough to reduce material costs and the overall weight for portability. Alternatively, the tile 4 can be formed of wood, metal, hard plastics, or the like. Because the tiles 4 can be easily put into a container to carry around, this embodiment provides a portable game suitable for team work training at various locations.

Figure 3:
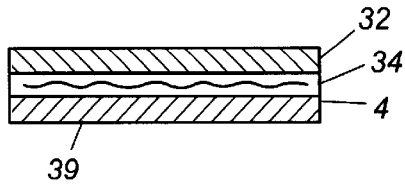
FIG. 3 shows a cross-sectional view of the tile shown in FIG. 2.

FIG. 3 shows a cross-section view of the tile 4. Each tile 4 is covered with a polarized film 32. The polarized film 32 can be adhered to the tile 4 utilizing a variety of methods including gluing, welding, sewing, or bonding the polarized film 32 to the tile 4. In an alternative embodiment, a layer of paper, plastic or other proper material 34 may be interposed between the tile 4 and polarized film 32 to provide a better contrasting background.

An underside 39 of the tile 4 can be made either smooth or rough. Preferably, the underside 39 of the tile 4 is rough or textured providing better conformation between the tile 4 and the floor F preventing slipperiness.

To a naked eye, as shown in FIG. 1, the playing area 10 is just a matrix made up of tiles 4 having a marking. In one embodiment, the tiles 4 are substantially similar. In an alternative embodiment, the tiles 4 form a design. Certain tiles form a path across the playing area that can only be seen through the optical instrument 12.

Figure 4:
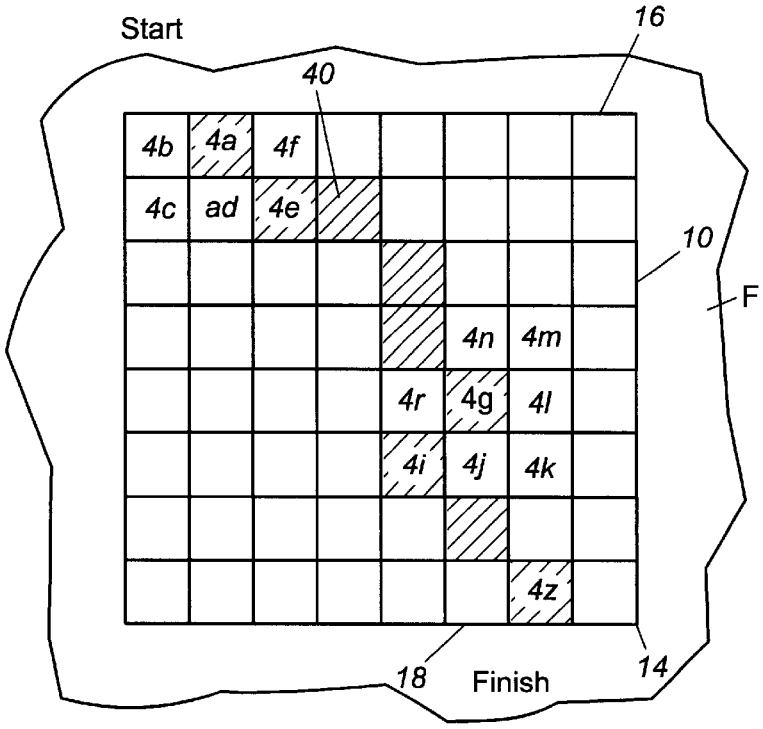
FIG. 4 shows the playing area of FIG. 1 with a path revealed to a facilitator utilizing the polarized optical instrument.

With reference to FIG. 4, a path 40 through the playing area 10 as seen through the polarized glasses 12 is shown. As shown, these tiles 4*a*–4*z* are arranged with their polarization axes substantially parallel to each other but also substantially perpendicular to that of the surrounding tiles. The polarized light reflected from these tiles is blacked out by the polarized glasses 12. The view perceived through polarized glasses 12 shows a shading difference between the path 40 and its surrounding.

In this game, a game facilitator (not shown) wears the polarized glasses 12, so the facilitator can set up the path 40 prior to the game and also see the path 40 on the playing area 10 during the game. In FIG. 4, the path 40, indicated by the dark shading, starts from tile 4*a* located at end 16 and ends at tile 4*z* located at end 18. Moving from tile 4*a* to tile 4*z* takes 9 steps, traversing one tile at a time. Obviously, path 40 can take different routes to cross the playing area 10, with more or less steps along the path 40.

Figure 5:
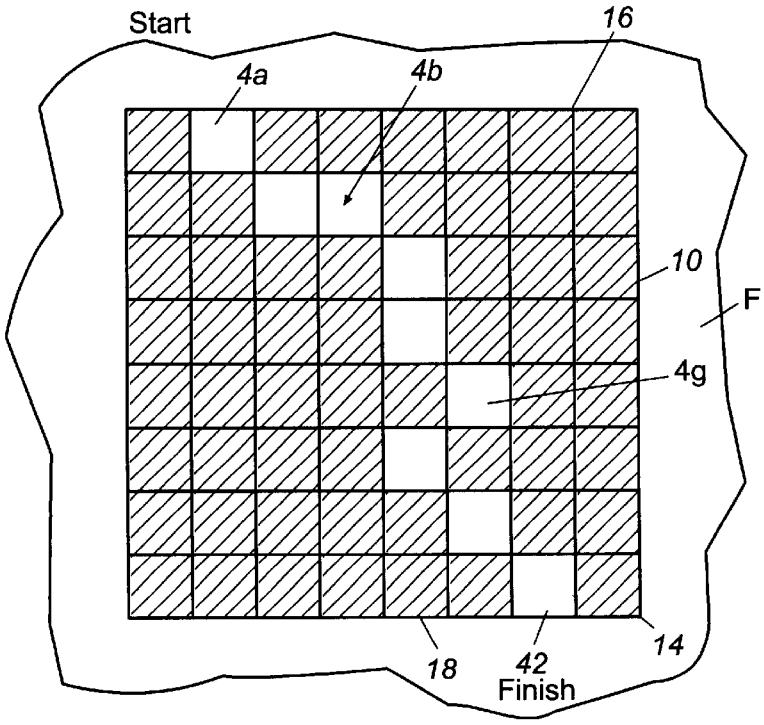
FIG. 5 shows the playing area of FIG. 4 where the facilitator changes position which rotates the view seen through the polarized optical instrument by 90°.

As shown in FIG. 5, the view perceived through the polarized glasses 12 changes when the facilitator changes position. Nevertheless, the shading difference between the path 40 and its surrounding exists making the path 40 recognizable to the facilitator as illustrated in FIGS. 4 and 5.

In playing the game, teams take turns getting on the playing area 10. Teams strive to be the first team to have each player discover the path 40 and all players cross the playing area 10 first. The view observed by the players of the playing area 10 (as shown in FIG. 1) is that all tiles 4 are substantial identical. The facilitator starts the game by telling the first player which side to start on. For example, as illustrated in FIG. 4, the facilitator tells the first player whether tile 4*a* is on the path 40. If yes, the facilitator asks the player to find the next section of the path 40. From tile 4*a*, the player has five possible direction choices, i.e., tiles 4*b* to 4*f*. Because only tile 4*e* is the right choice, the odds for the player to get it right at first try is 1 out of 5. The player guesses whether a particular tile 4 is on path 40. The facilitator tells the player whether his or her guess is correct. If the guess is correct, the player advances to the correct tile, that is tile 4*e*. If not, the player moves off the matrix and waits for his or her next opportunity to play. A second player plays. The second player guesses based on the learning from his or her predecessor, where the next section of the path 40 exists. If the second player pays attention to the first player and eliminates the first player's wrong choice, the odds for the second player to get it right at first try would be 1 out of 4. Because at any given step of the path 40, a player has at least two possible directions to go, an appreciation of his or her predecessor(s)'s experience(s) will enhance his or her chances to get it right at first try. Accordingly, the whole team finishes the game quicker if they all pay attention to each other's experience. Thus, playing the game becomes a process of players learning from each other and a team building experience.

The facilitator normally wears a pair of polarized glasses 12. Alternatively, the facilitator can wear a set of polarized spectacles in a form of goggles. Further, the facilitator can utilize a polarized sheet to set up and monitor the game. The facilitator has freedom to set up the playing area 10 as he so chooses. The path 40 can be chosen in a way that the number of tiles 4 in the path 40 equals the number of players. This configuration allows every player to take up one tile 4 on the path 40 in one game. Or the path 40 can be chosen in a way that the number of tiles 4 in the path 40 is greater than the number of players. In this case, players take up more tiles 4 on the path 40 in one game by, for example, starting from a player at the position where the last player ended in the first round of the game.

In an alternative embodiment, the game can be played by one or more teams in a competitive environment. Each team may have one or more players. Teams can play the game on a same playing area 10 such as the one shown in FIG. 1. Teams take turns playing on the playing area 10 attempting to discover and traverse the path 40. Playing the game facilitates the team spirit among the players.

Figure 6:
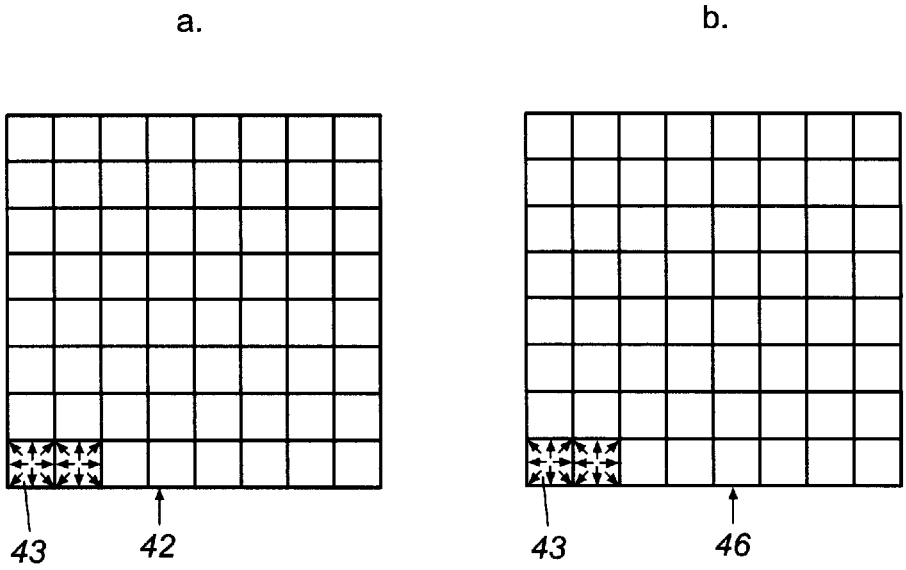
FIG. 6 shows a top unfiltered view of an alternative embodiment of this invention including two playing areas.

In another alternative embodiment shown in FIG. 6, teams play the game on different playing areas 42, 46. The game facilitator sets up different paths with same number of tiles 43 on each playing area 42, 46.

Figure 7:
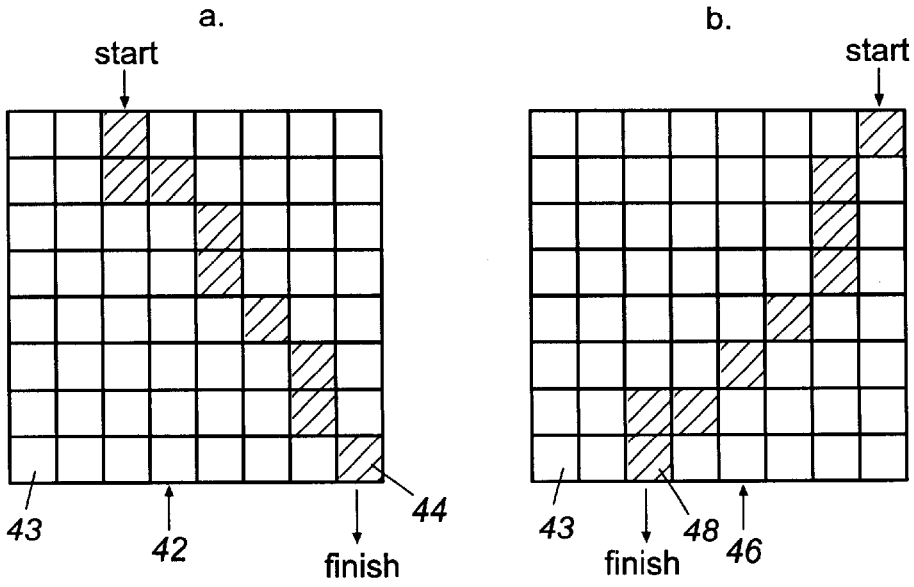
FIG. 7 shows the playing area of FIG. 6 showing crossing paths on each playing area as viewed by a facilitator utilizing an optical instrument.

FIG. 7 shows a two team set up having two different paths 44, 48. The path 44 in one playing area 42 is a different route from the path 48 in the other playing area 46. However, both path 44 and path 48 have an equal number of tiles 43 or steps. This maintains the difficulty of the game. That is, the players in a team cannot benefit from their counterpart's experience because the paths 44, 48 are different, without losing its fairness. Each team then tries to find the path 44, 48 on its turf and cross the playing area 42, 46 first to win.

Operationally, the game utilizes use square or rectangular tiles to construct a playing area. Alternatively, tiles with other shapes, such as circular, diamond, oval or other kinds of geometrical configuration can be utilized to establish a playing area. Furthermore, the game can be played on any surface. For instance, a mini version of the game can be played on a desk, table, or other supporting structures.

Moreover, the invention can also be practiced for leisure. In yet another alternative embodiment, the game can be played by an individual to enhance his or her memory. Alternatively, the game can be played just for fun.

In another embodiment, the tiles can be constructed from a variety of materials, such as a woven carpet. The woven carpet can be sized nine inch by nine inch. A multitude of woven carpet tiles are placed adjacent to each other forming a playing surface. In this embodiment, the polarized film is a one inch square area disposed on the woven carpet. The one inch square polarized film can be positioned anywhere on the woven carpet, preferably located in a corner of the woven carpet. The game is played in the same manner as described above with a facilitator utilizing an optical instrument.

While certain embodiments of this invention have been described above, these descriptions are given for purposes of illustration and explanation. Variations, changes, modifications and departures from the systems and methods disclosed above may be adopted without departure from the spirit and scope of this invention.

What is claimed is:

1. A game playing apparatus, comprising:

a) panels positioned adjacent to each other forming a playing area, the panels having an upper surface having a film for polarizing incident light thereon; and b) an optical instrument receiving light reflected from the panels, wherein a path across the playing area is identifiable utilizing the optical instrument.

2. The game playing apparatus of claim 1, wherein the film comprises polarized film.

3. The game playing apparatus of claim 2, wherein the polarized film comprises visible marks.

4. The game playing apparatus of claim 2, wherein the polarized film is formed of light-sensitive materials.

5. The game playing apparatus of claim 2, wherein the polarized film comprises a polarized sheet.

6. The game playing apparatus of claim 1, wherein the optical instrument comprises a pair of polarized glasses.

7. The game playing apparatus of claim 1, wherein the optical instrument comprises a set of polarized spectacles.

8. The game playing apparatus of claim 1, further comprising a bottom surface on each panel.

9. The game playing apparatus of claim 8, wherein each panel is formed of a flexible material so that the bottom surface of each panel contours to a playing surface.

10. The game playing apparatus of claim 9, wherein the flexible material comprises plastic.

11. The game playing apparatus of claim 8, wherein the bottom surface of each panel is textured such that friction between the bottom surface and a playing surface prevents the panels from sliding along the playing surface.

12. A game playing apparatus, comprising:

a) a plurality of base plates having a top surface and a bottom surface, the bottom surface of each base plate adapted for placement on a floor surface and the top surface capable of supporting a person standing thereon;

b) a film for polarizing incident light disposed on the top surface of each base plate; and c) an optical instrument for receiving light reflected from the film.

13. The game playing apparatus of claim 12, wherein the film comprises polarized film.

14. The game playing apparatus of claim 13, wherein the polarized film is formed of light-sensitive material.

15. The game playing apparatus of claim 12, wherein the film comprises visible markings.

16. The game playing apparatus of claim 12, wherein the optical instrument comprises a pair of polarized glasses.

17. The game playing apparatus of claim 12, wherein the optical instrument comprises a set of polarized spectacles.

18. The game playing apparatus of claim 12, wherein the films have substantially identical marks thereon.

19. The game playing apparatus of claim 12, wherein each base plate is formed of a flexible material such that the bottom surface of each base plate substantially conforms to the floor surface.

20. The game playing apparatus of claim 19, wherein the flexible material comprises plastic.

21. The game playing apparatus of claim 12, wherein the bottom surface of each base plate is textured such that friction between the bottom surface and the floor surface prevents the base plate from sliding on the floor surface.

22. The game playing apparatus of claim 12, wherein each base plate is formed of a rigid material with sufficient flexibility to allow the bottom surface of each base plate to be in contacting relation with the floor surface.

23. A game playing apparatus, comprising:

a) a base plate having a top surface and a bottom surface;

b) a film for polarizing incident light disposed on the top surface of the base plate; and c) an optical instrument for receiving light reflected from the film wherein each base plate is formed of a rigid material with sufficient flexibility to allow the bottom surface of each base plate to be in contacting relation with a surface of an existing floor wherein the rigid material comprises tile.

24. A method for playing a game by a group of players, comprising:

a) setting up a playing area with panels, wherein each panel is covered with a polarized film that when viewed through an optical instrument a path across the playing area is revealed;

b) guessing by a player not wearing the optical instrument whether a particular panel is on the path;

c) determining by a facilitator wearing the optical instrument if the guess is correct;

d) positioning the player on the path if the guess is correct or moving the player off the playing area if the guess is incorrect;

e) guessing by a next player where is the next step of the path; and f) repeating steps b) to e) till the whole path is discovered.

25. The method according to claim 24, wherein the setting up a playing area with panels step is performed with the optical instrument comprising polarized glasses.

26. A method for playing a game, comprising:

a) setting up a playing matrix with substantially identical game pieces, wherein a path crosses the playing matrix that is revealable utilizing an optical instrument;

b) guessing whether a particular game piece is on the path;

c) determining whether the guess is correct;

d) if the guess is correct, whether a next game piece is on the path; and e) repeating steps b) to d) till the entire path is discovered.

27. The method of claim 26, wherein the step of setting up a playing matrix with substantially identical game pieces is performed utilizing polarized glasses receiving light reflected from the game pieces.

28. The method of claim 27 further comprising covering each game piece with a polarized film.

* * * * *